US006889533B2

(12) United States Patent
Fuller

(10) Patent No.: US 6,889,533 B2
(45) Date of Patent: May 10, 2005

(54) REMOVABLE KEYLESS TURNING MECHANISM FOR LOCKS

(75) Inventor: Mark Weston Fuller, Houston, TX (US)

(73) Assignee: Fuller Bros. Lock, Inc., Houston, TX (US)

( * ) Notice: Subject to any disclaimer, the term of this patent is extended or adjusted under 35 U.S.C. 154(b) by 327 days.

(21) Appl. No.: 09/872,564

(22) Filed: Jun. 1, 2001

(65) Prior Publication Data

US 2001/0047672 A1 Dec. 6, 2001

Related U.S. Application Data

(60) Provisional application No. 60/209,325, filed on Jun. 2, 2000.

(51) Int. Cl.[7] ..... E05B 9/04

(52) U.S. Cl. ..... 70/375; 70/367; 70/370; 70/371

(58) Field of Search ..... 70/375, 371, 367, 70/368, 369, 370

(56) References Cited

U.S. PATENT DOCUMENTS 4,328,690 A * 5/1982 Oliver ..... 70/367
4,843,852 A * 7/1989 Foshee et al. ..... 70/368
5,235,832 A * 8/1993 Lux et al. ..... 70/370
5,291,767 A * 3/1994 Weindorf et al. ..... 70/368
5,355,703 A * 10/1994 Elinski et al. ..... 70/369
5,813,260 A * 9/1998 Widen ..... 70/369
5,970,760 A * 10/1999 Shen ..... 70/369
6,122,943 A * 9/2000 DaWalt et al. ..... 70/100

OTHER PUBLICATIONS

Catalog of Schlage Small Format Interchangeable Core Products.

Catalog of Mortise Cylinders.

Instructions for Rekeying the Sargent #65–6300 Removable Core Assembly.

* cited by examiner

*Primary Examiner*—J J Swann
*Assistant Examiner*—Michael J. Kyle
(74) *Attorney, Agent, or Firm*—Moser, Patterson & Sheridan, LLP

(57) ABSTRACT

A removable thumbturn core assembly which replaces a key core assembly after removing a key cylinder with a control key. The control key feature is preserved for removing the key cylinder.

19 Claims, 6 Drawing Sheets

REMOVABLE KEYLESS TURNING MECHANISM FOR LOCKS

RELATED APPLICATION

This application claims benefit of U.S. provisional patent application Ser. No. 60/209,325, filed Jun. 2, 2000, which is herein incorporated by reference.

BACKGROUND OF THE INVENTION

1. Field of the Invention

This invention relates to locks, specifically to an improved actuating mechanism for operating locks.

2. Background of the Related Art

To secure a door against undesirable or unwanted entry, the door is provided with a lock. The lock is intended to secure the door when closed until the lock is actuated to an unlocked status to allow the door to be moved to an open position. Typically, a door is fastened to a frame which defines an opening in a wall, fence, or other enclosure. This is done in a manner which allows the door to be moved with respect to the opening to permit access and then reposition the door quickly and easily while maintaining the door in alignment to reseal the opening. This may be accomplished by using hinges on one of the stiles of the frame, or the door may be located on rollers, or may hang on rollers or be otherwise movable.

To change the lock from a locked to an unlocked status, (or vice versa) many locks are actuated by a key on the exterior side of the door and a thumbturn (a small handle) on the interior side. In some cases it is desirable for the lock to be operated by a key on the inside of the door as well as the outside, particularly when securing the contents of a room is more important than ease of egress.

Due to increasing government regulation and concern over issues of life safety in a building occupied by the public or used for commercial purposes, the local authority with jurisdiction may deem it necessary to change a lock which is actuated by a key on the inside of a door to thumbturn operation or vice versa, depending on the use and occupancy requirements of the building. In some instances complying with a request to change a lock is difficult. For example, it is very common, particularly with glass doors, for a lock to be installed in the bottom edge of the door which extends a bolt into the floor to secure the opening. In this event, to change the function of a lock from one type of actuation to the other, it is frequently necessary to remove the door from its frame mounting in order to access the lock so that the change can take place.

Removing the door must also occur in the normal routine if rekeying the locks in glass doors so that they can be operated by a different key. To accomplish this a company specializing in the installation and repair of glass doors may be contracted to perform the task of removing the door so that a technician specializing in the installation and repair of locks can perform the task of rekeying the lock.

Once the door is removed it must be positioned in a stable manner with the bottom edge revealed. Next, it may be necessary to remove a plate which covers the setscrew that secures the key actuating mechanism (also called a key cylinder) into the lock case. With setscrew loosened, the cylinder is removed so that it can be rekeyed. Once this procedure is completed, these steps must be repeated in the reverse order to finish the job. This is not only inconvenient but also relatively expensive and very time consuming.

A removable core key cylinder, shown in FIG. 1, (also referred to as an interchangeable core cylinder) can be used to simplify rekeying a lock. This type of cylinder is a "core" that fits into a "housing" (not shown) that is installed in a lock in the same manner as any cylinder unit. The core 10 typically includes a control lug 12, a barrel 14 that receives a key (not shown), and a body 16. The control lug 12 is released by a special key (not shown), commonly referred to as a control key. The control key enables the layman to rekey the lock by removing the core 10 of the key assembly and then replace the core 10 with another operated by a different key without dismantling the lock or door assemblies. This simple method of rekeying the lock however is not available if the function of the lock must change from key actuation to thumbturn actuation or vice versa. This is because in a key operated cylinder, the special key is inserted in the keyway 18 (or key hole) located in the barrel 14. Conversely, in a thumbturn operated cylinder, a handle replaces the keyway. Since there is no keyway or provision in the front of a thumbturn cylinder to insert a control key, a thumbturn could not be removed by a control key. The present invention solves the problem of replacing a removable core key cylinder with a thumbturn.

SUMMARY OF THE INVENTION

A removable core thumbturn cylinder is supplied by the present invention which features a dual-action turning element. The thumbturn cylinder replaces a key cylinder in a removable core housing in a matter of seconds without dismantling a portion of the lock or the door assembly.

The removable core thumbturn cylinder is configured to be compatible with the housing portion of an available key cylinder assembly so that replacement of the housing is not necessary. The control key is used to remove the key cylinder from the housing. A control key or other special tool is not needed for removing the thumbturn cylinder from the housing.

BRIEF DESCRIPTION OF THE DRAWINGS

So that the manner in which the above recited features, advantages, and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
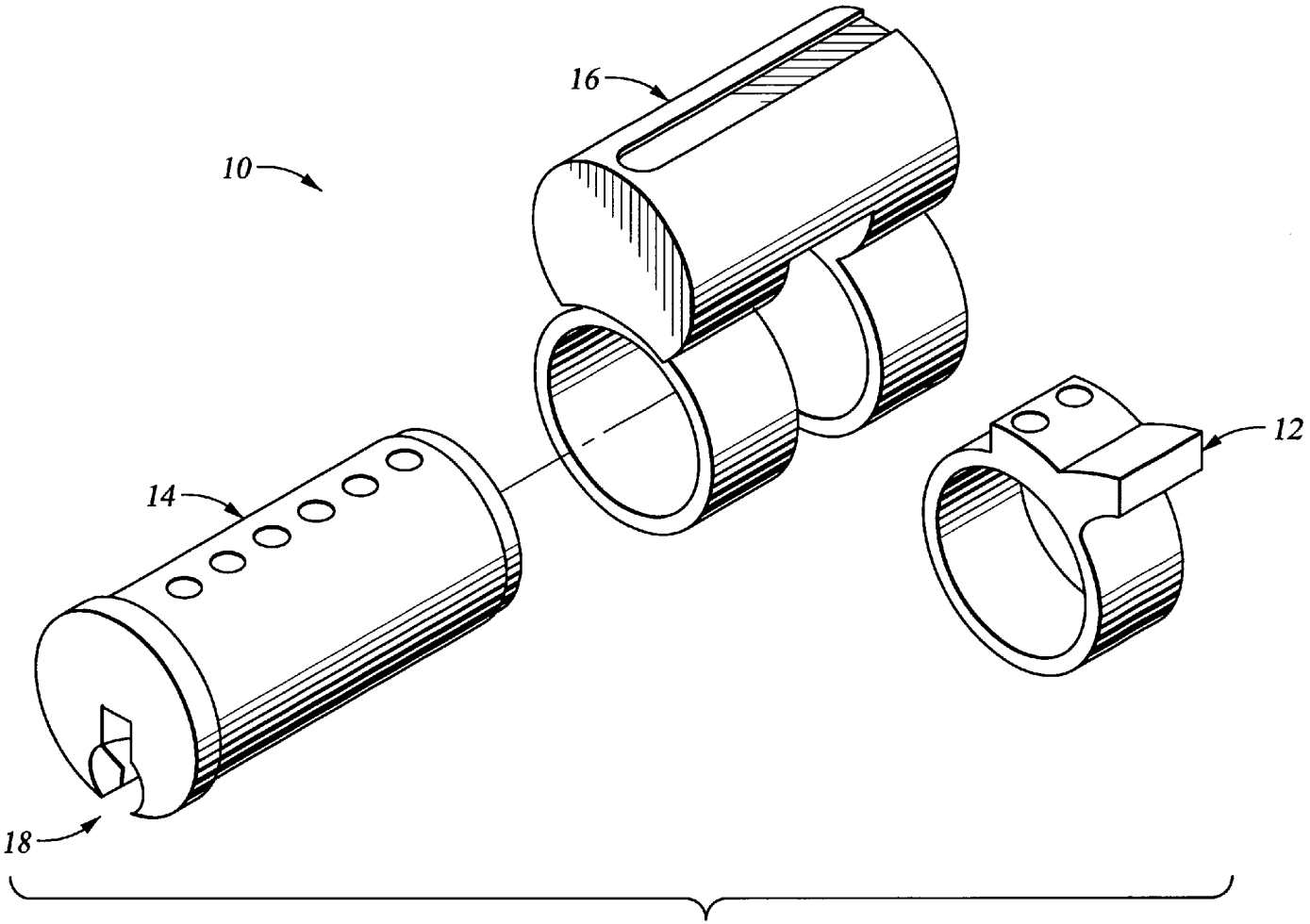
Fig. 1 (PRIOR ART)
FIG. 1 (prior art) shows a removable core key cylinder which is easily removed from a conventional key assembly.
Figure 2:
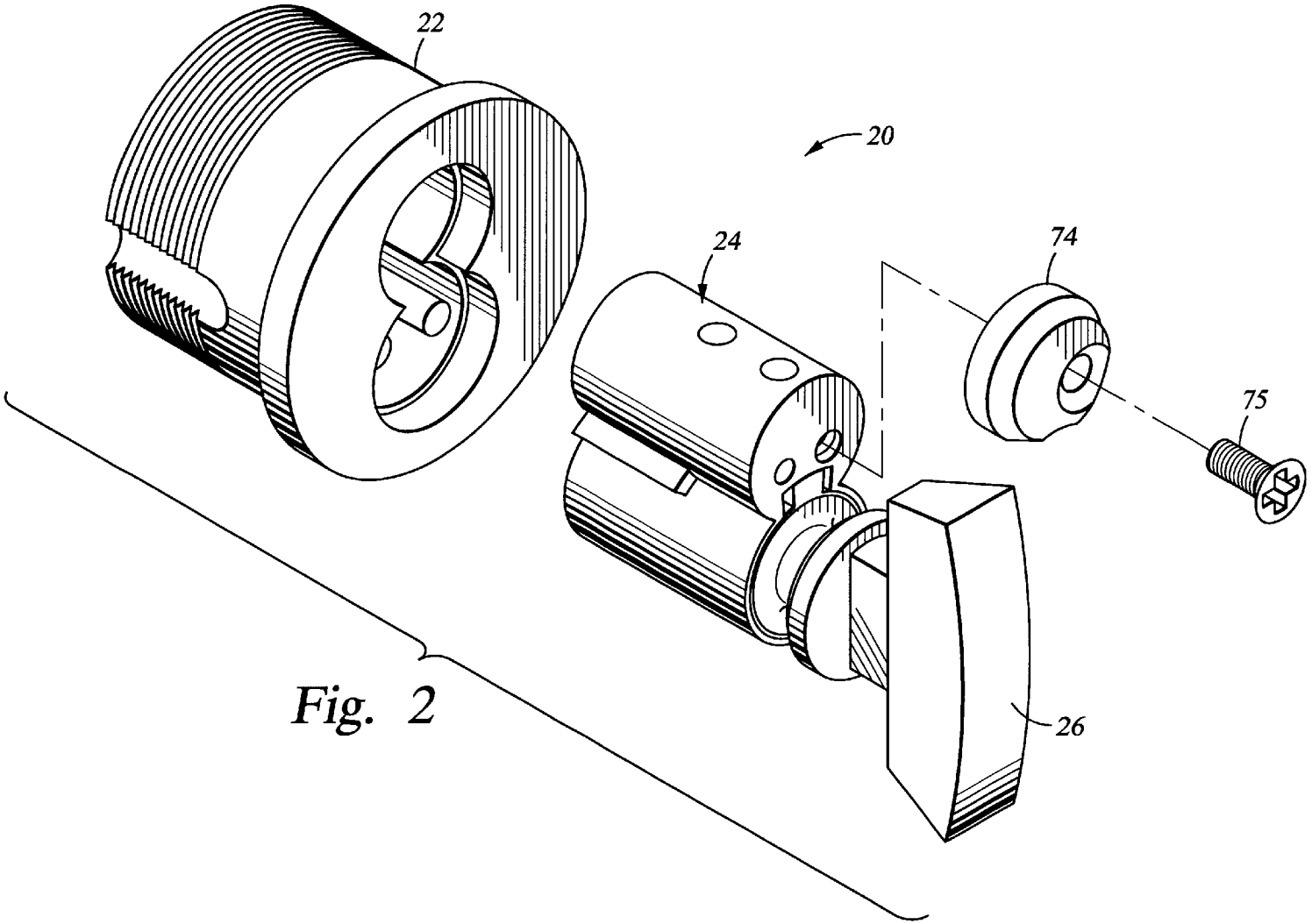
FIG. 2 shows a removable core thumbturn assembly of the present invention.
Figure 4:
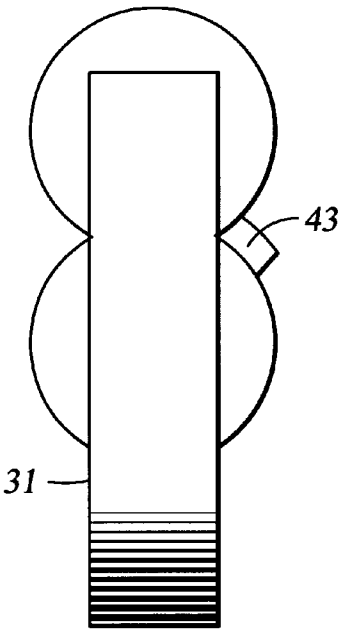
FIGS. 3–4 show a removable core thumbturn cylinder with a control lug in an extended position.
Figure 3:
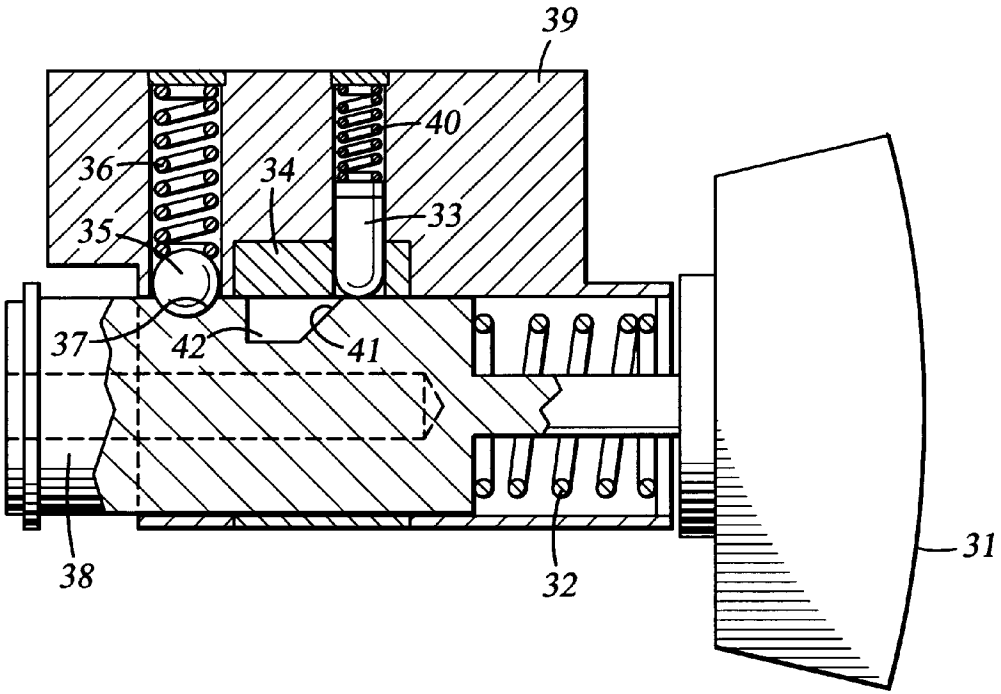
Figure 6:
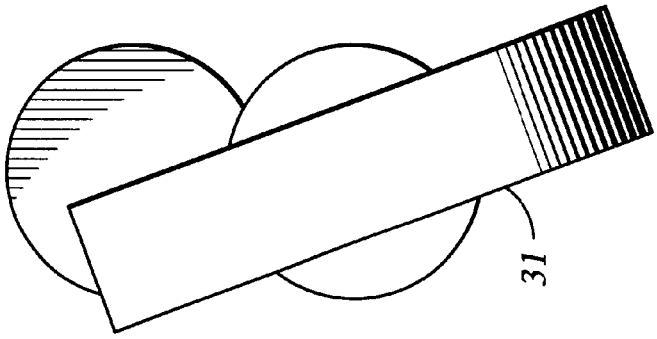
FIGS. 5–6 show the thumbturn cylinder of FIGS. 3–4 with the turning element pulled out and rotated slightly, engaging a control feature, and withdrawing the control lug.
Figure 5:
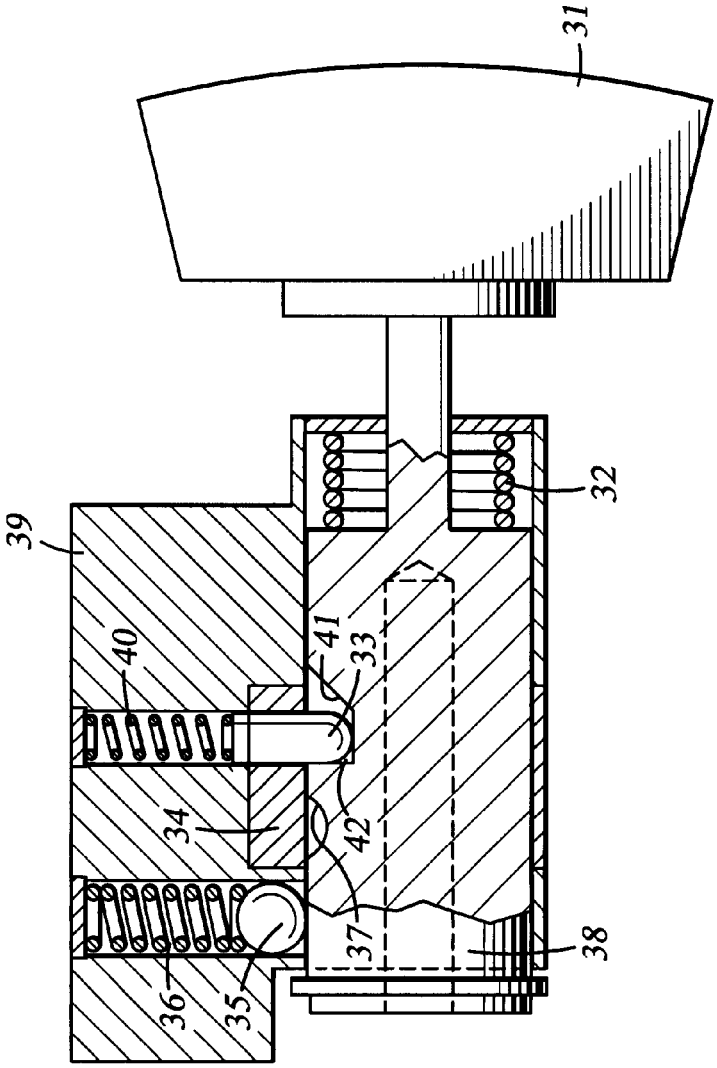
Figure 9:
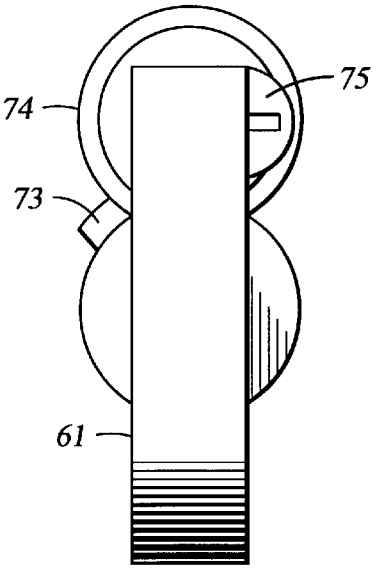
FIGS. 7–9 show an alternative design of a thumbturn cylinder that fits within the standard housing of a cylinder unit.
Figure 8:
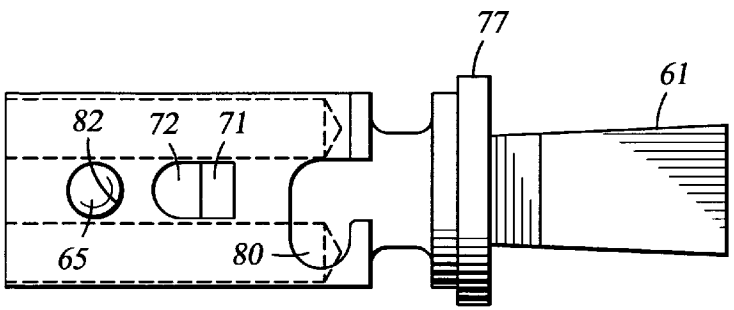
Figure 7:
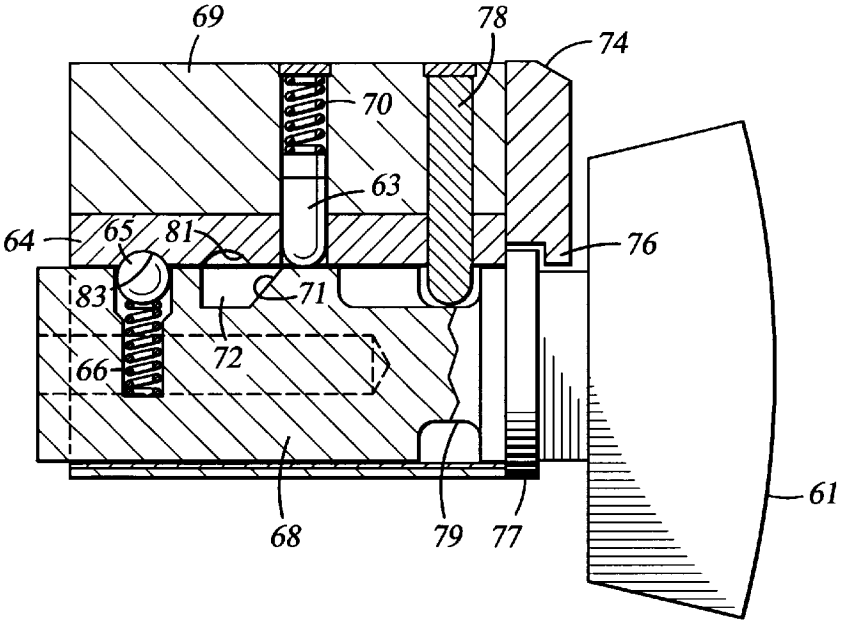
Figure 11:
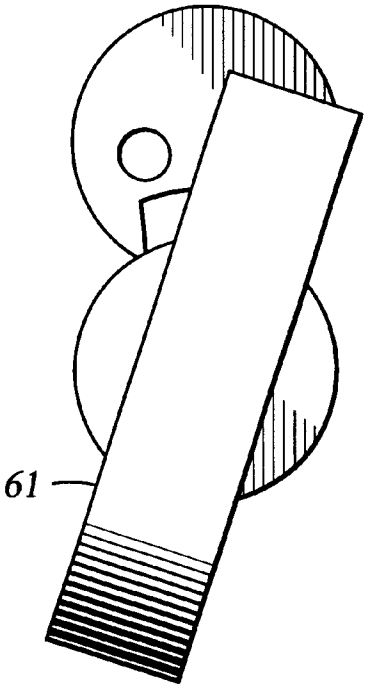
FIGS. 10–11 show the alternate design of FIGS. 7–9 in a rotated position for removal of the thumbturn cylinder.
Figure 10:
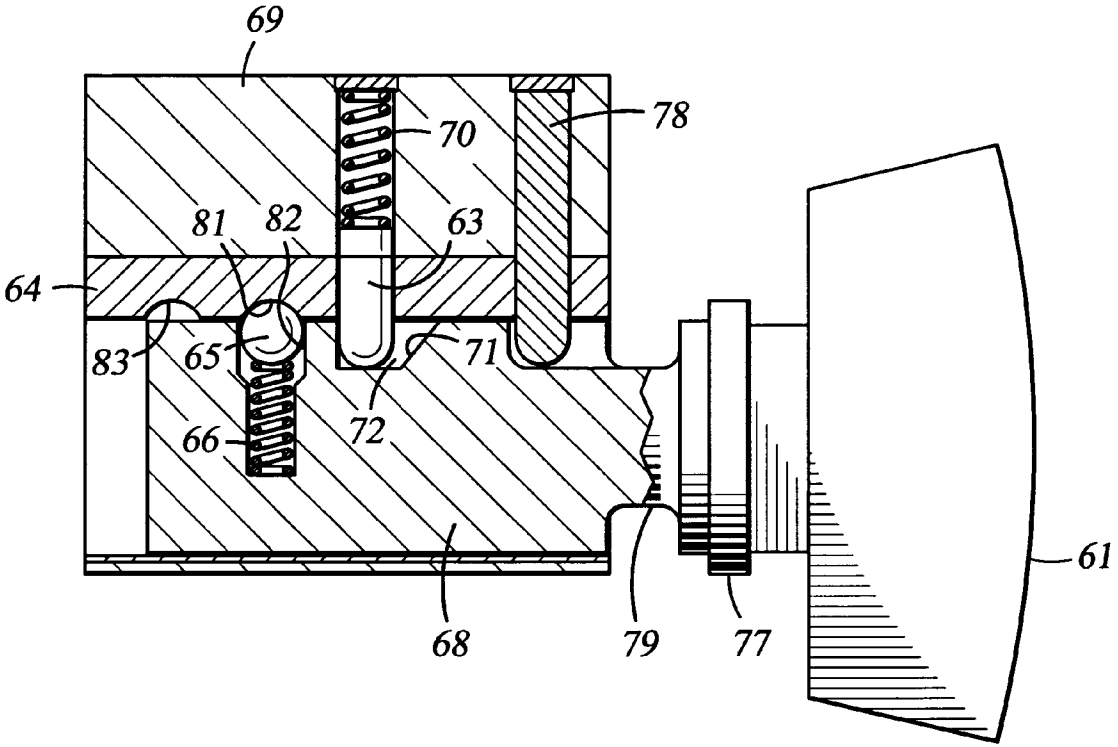

A keyless thumbturn core assembly 20 that includes a conventional housing 22 and a thumbturn cylinder 24 is shown in FIG. 2. The "control key" feature is preserved for removing the conventional key cylinder. Preferably the control key is not needed for removing the thumbturn cylinder as shown.

In one aspect, the present invention provides a dual action thumbturn cylinder 24 (See FIG. 2). When installed in the housing 22, a handle 26 rotates to actuate a locking mechanism and also slides in and out with respect to the housing 22 to actuate a feature which retains and releases the thumbturn cylinder 24 from the housing.

Referring to an embodiment shown in FIGS. 3–6, by pulling out on a handle 31 of a turning element plug 38, the control pin 33, under spring pressure 40, slides down a ramp 41 into the control pin cavity 42 in the turning element plug 38. This captures the control pin 33 between the turning element plug 38, and the control sleeve 34. By rotating the handle 31 of the turning element plug 38 the control pin 33 causes the control sleeve 34 to rotate with the turning element plug 38 far enough to withdraw the lug portion 43 (see FIG. 4) of the control sleeve 34 into the shell 39 (see FIG. 6) and allow removal of the thumbturn cylinder from a housing. Once the handle is released, the spring 32 causes the turning element plug 38 to slide back into the shell 39 which forces the control pin 33 up the ramp 41 of the control pin cavity 42 (where it resides for normal operation of the lock, skimming the cylindrical surface of the turning element plug 38). In this position, the control pin 33 prevents rotation of the control sleeve 34 by rotation of the handle 31 of the turning element plug 38, thereby enabling the thumbturn cylinder to remain secure within the housing and provide actuation of a lock mechanism.

Referring to FIGS. 3–6, to remove the thumbturn cylinder from the housing, rotate the turning element handle 31 until a ball bearing or "locator ball" 35, under spring pressure 36, meets a notch 37 in the top of the turning element plug 38. The correct position is determined when a clicking sensation is felt/heard and the handle is in the vertical position (See FIG. 4). Once the turning element handle 31 is correctly positioned for core removal, simply pull the handle straight out (see FIG. 5), and rotate slightly left (see FIG. 6) or right (depending on the manufacturers housing in the given installation) to withdraw the control lug 43 into the shell 39, which allows the thumbturn cylinder to be extracted from the housing. To install, repeat this procedure outside the housing and replace the thumbturn cylinder into the housing.

An alternative embodiment is depicted in FIGS. 7–11. This embodiment operates in the same manner and contains all the elements of the design shown in FIGS. 3–6, except for a spring. In lieu of a spring, a retaining cap 74 (see FIG. 7) is applied to the front of the cylinder 24 and is fastened to the front of the shell 69 by a screw 75 (See FIGS. 2 and 9). The retaining cap 74 has a lip 76 which extends over a flanged portion 77 of the turning element plug 68 and keeps the turning element plug 68 from being pulled out until the screw 75 is removed with the correct tool.

Another feature differentiating this embodiment from FIGS. 3–6 is a guide pin 78 which extends through the shell 69 from the top of the shell 69 to the groove 79 around the turning element plug 68. The guide pin 78 serves two purposes. Once the locator ball 65, under spring pressure 66, meets the notch 83 and the handle 61 is in the vertical position, the turning element control groove 80 (see FIG. 8) will be aligned with the guide pin 78. The control groove 80 forms a "dog leg" which extends from and is perpendicular to the groove 79 around the turning element plug 68. This "dog leg" groove 80 creates a "path" for the guide pin 78 allowing the turning element plug 68 to slide outward and engage the control pin 63, under spring pressure 70 (see FIG. 10), and then rotate slightly to withdraw the control lug 73 (see FIGS. 9 and 11) allowing the thumbturn cylinder to be removed from the housing. The guide pin 78 also serves to prevent the turning element plug 68 from being pulled out too far should the control pin 63 get trapped within its chamber and not travel down the ramp 71 into the control pin cavity 72 in the turning element plug.

The locator ball 65 is arranged differently in the example given in FIGS. 7–11. Because the control sleeve 64 extends the length of the shell 69 in this design, it is preferable to reverse the locator ball spring chamber 82 and install it in the turning element plug 68. This version has two locator ball notches 81, 83 instead of only one, and the notches are inverted and located in the inside diameter of the control sleeve 64. Like the design submitted in FIGS. 3–6, the locator ball 65 "clicks" into the "operating notch" 83 with each complete revolution of the turning element handle 61, and indicates when the turning element is positioned for core extraction. The additional "control notch" 81, shown in FIGS. 7 and 10, serves to "snap" the turning element outward when the retaining cap 74 is removed and the turn element handle 61 is pulled out to engage the control feature.

The scope of application is intended to include any device that includes a removable thumbturn cylinder.

The exterior dimensions of the removable core thumbturn assemblies are compatible to that of popular industry standard removable key core housings so that they are interchangeable between housings manufactured by different companies. The thumbturn components may be fabricated from durable plastics or a variety of alloys which are both easily machined and resistant to detrimental atmospheric conditions. The method of manufacturing these parts would include extruding, casting, and stamping with possibly some subsequent machining necessary in finishing the parts.

While the foregoing is directed to the preferred embodiment of the present invention, other and further embodiments of the invention may be devised without departing from the basic scope thereof, and the scope thereof is determined by the claims that follow.

What is claimed is:

1. A method of removing a thumbturn assembly from a locking mechanism, comprising retracting a control lug into the thumbturn assembly and then withdrawing the thumbturn assembly from the locking mechanism, wherein the retracting the control lug comprises pulling a thumbturn handle outwardly from the thumbturn assembly and then rotating the thumbturn handle.

2. The method of claim 1, wherein the pulling a turn handle outwardly engages a control pin in a control pin cavity within a turning element plug.

3. The method of claim 2, further comprising first rotating the thumbturn handle before the pulling a thumbturn handle.

4. The method of claim 3, wherein the first rotating the thumbturn handle aligns a control groove within the turning element plug with a guide pin.

5. The method of claim 3, wherein the first rotating the thumbturn handle aligns a locator ball with a notch within the turning element plug.

6. A thumbturn cylinder for replacing a key cylinder in a locking mechanism, comprising:

a shell;

a control sleeve connected to the shell;

a turning element plug secured within the control sleeve;

a control lug protruding from the control sleeve;

a handle operably connected to the turning element plug;

means for allowing the handle to be pulled outwardly from the thumbturn cylinder; and means for rotating the handle to withdraw the control lug into the shell.

7. The thumbturn cylinder of claim 6, wherein the means for allowing the handle to be pulled outwardly from the thumbturn cylinder comprises a control pin that engages a control pin cavity within the turning element plug.

8. The thumbturn cylinder of claim 7, further comprising means for first rotating the handle before pulling the handle outwardly from the thumbturn cylinder.

9. The thumbturn cylinder of claim 8, wherein the means for first rotating the handle aligns a control groove within the turning element plug with a guide pin.

10. The thumbturn cylinder of claim 9, wherein a retaining cap is connected to the shell to secure the turning element plug in the control sleeve.

11. The thumbturn cylinder of claim 8, wherein the means for first rotating the handle aligns a locator ball with a notch within the turning element plug.

12. The thumbturn cylinder of claim 11, wherein a spring is operably connected to the handle to retain the turning element plug in the control sleeve.

13. A removable core thumbturn assembly that is interchangeable with a removable key cylinder, comprising:

a shell;

a control sleeve connected to the shell;

a turning element plug secured within the control sleeve, the turning element plug having a control pin cavity;

a control pin;

a control lug protruding from the control sleeve; and a handle operably connected to the turning element plug.

14. The removable core thumbturn assembly of claim 13, wherein the turning element plug has a notch.

15. The removable core thumbturn assembly of claim 14, further comprising a locator ball.

16. The removable core thumbturn assembly of claim 15, wherein a spring is operably connected to the handle to retain the turning element plug in the control sleeve.

17. The removable core thumbturn cylinder of claim 13, wherein the turning element plug has a control groove.

18. The removable core thumbturn cylinder of claim 17, further comprising a guide pin.

19. The removable core thumbturn cylinder of claim 18, wherein a retaining cap is connected to the shell to retain the turning element plug in the control sleeve.

* * * * *

UNITED STATES PATENT AND TRADEMARK OFFICE

CERTIFICATE OF CORRECTION

PATENT NO. : 6,889,533 B2
DATED : June 1, 2001
INVENTOR(S) : Mark Weston Fuller

It is certified that error appears in the above-identified patent and that said Letters Patent is hereby corrected as shown below:

Column 4,
Line 50, change "turn" to -- thumbturn --.

Signed and Sealed this

Thirteenth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,889,533 B2
APPLICATION NO. : 09/872564
DATED : May 10, 2005
INVENTOR(S) : Mark Weston Fuller It is certified that error appears in the above-identified patent and that said Letters Patent is hereby corrected as shown below:

Column 4,
Line 50, change "turn" to -- thumbturn --.

This certificate supersedes Certificate of Correction issued June 13, 2006.

Signed and Sealed this

Twenty-eighth Day of November, 2006

JON W. DUDAS
*Director of the United States Patent and Trademark Office*